United States Patent [19]

Viñas

[11] Patent Number: 4,974,341

[45] Date of Patent: Dec. 4, 1990

[54] APPARATUS FOR DRY TREATMENT OF A FABRIC

[75] Inventor: Jaime A. Viñas, Matadepera, Spain

[73] Assignee: Jaume Anglada Viñas S.A., Spain

[21] Appl. No.: 345,717

[22] Filed: May 1, 1989

[30] Foreign Application Priority Data

May 6, 1988 [ES] Spain ..... 8801392
Oct. 10, 1988 [ES] Spain ..... 8803076

[51] Int. Cl.[5] ..... F26B 13/00
[52] U.S. Cl. ..... 34/156; 34/191
[58] Field of Search ..... 34/155, 10, 151, 156, 34/191

[56] References Cited

U.S. PATENT DOCUMENTS 4,679,333 7/1987 Vinas ..... 34/151 X

*Primary Examiner*—Henry A. Bennet
*Attorney, Agent, or Firm*—McGlew and Tuttle

[57] ABSTRACT

An apparatus for the dry treatment of a fabric in which the fabric passes repeatedly from a first chamber to a second chamber and back again through a passage in which air is blown in the appropriate direction. Within each chamber facing the port of the passage, there is a fabric receiving device which allows the air therethrough and receives the fabric without retaining it, whereby the fabric is piled in orderly fashion on a platform of the corresponding chamber. The device avoids irregular piling and entanglement of the fabric in the lengthwise direction. Adjustment of the control means of access of the air to the passage opposes a main current to a secondary current of air, producing compacting of the fabric.

14 Claims, 4 Drawing Sheets

APPARATUS FOR DRY TREATMENT OF A FABRIC

BACKGROUND OF THE INVENTION

1. Field of the Invention

The invention relates to an apparatus for dry treatment of a fabric, comprising a first chamber and a second chamber each of which is provide with a platform supporting a reserve of open width fabric, said first chamber being for an inlet reserve, and said second chamber being for a delivery reserve; means gradually feeding the fabric into said first chamber; means gradually removing the fabric from said second chamber; a passage having a flattened section containing the fabric in open width form and placing said chambers in communication with each other, having in each of the latter a port through which the fabric passes; blower means blowing air into said passage; heating elements for said air; a first set and a second set of slots in said passage for directing air respectively towards said first chamber or second chamber; first and second sets of gate valves comprising, on the one hand, control means for the access of the air respectively to the first set or second set of slots and, on the other hand, control means of the air return respectively from the first chamber or second chamber to the blower means, access control means and said return control means being movable between an open position and a closed position; and actuating means for said gate valve sets.

2. Description of the Prior Art

Spanish patent No. 532,408 to the present applicant discloses a method and apparatus for the treatment of a fabric, based on an alternating flow of air transporting the fabric from one chamber to another. Nevertheless, this patent does not precisely disclose the automatic system for reversing the air flow direction.

U.S. Ser. No. 796,605 of the same inventor discloses furthermore an automatic reversal system for the air flow direction. Said system is based on the friction that the fabric exerts, on being exhausted from one of the chambers, on a rocking lever. This system has the drawback of producing an undesired tension on the fabric, which may lead to deformation thereof.

Spanish patent application No. 8701418, also of the same inventor, discloses an apparatus in which the automatic air flow direction reversal system is determined by the weight of the corresponding pile, whereby the above mentioned tension is avoided.

Nevertheless, in the apparatus discussed above, irregularities sometimes occur in the formation of the piles, since the fabric entering one chamber from the other through the passage is frequently piled in a disorderly fashion, becoming entangled and the fabric does not spread evenly but partially winds up in the longitudinal direction, whereby it takes on a rope form making further traverse of the fabric through the passage difficult. Correct removal of the fabric from the second chamber is also hindered.

To overcome the said drawback, an apparatus of the type described above has been devised, characterised in that inside each of said chambers generally facing the corresponding port of the passage there is a fabric receiving device allowing the air flow therethrough and adapted to receive the fabric driven into the chamber from the passage without retaining it.

According to a further feature of the invention, one position close to or coinciding with the open position of the access control means associated with one set of slots, corresponds to an intermediate position between the open and closed positions of the other access control means, whereby unequal opposed air currents may flow in said passage, causing a fabric compacting action, compatible with a transfer of the fabric towards one of the chambers.

BRIEF DESCRIPTION OF THE DRAWING

Further advantages and features of the invention will be appreciated from the following description in which without any limiting nature there are described preferred embodiments of the invention, with reference to the accompanying drawing. In the drawings.

DETAILED DESCRIPTION OF THE INVENTION

Figure 1:
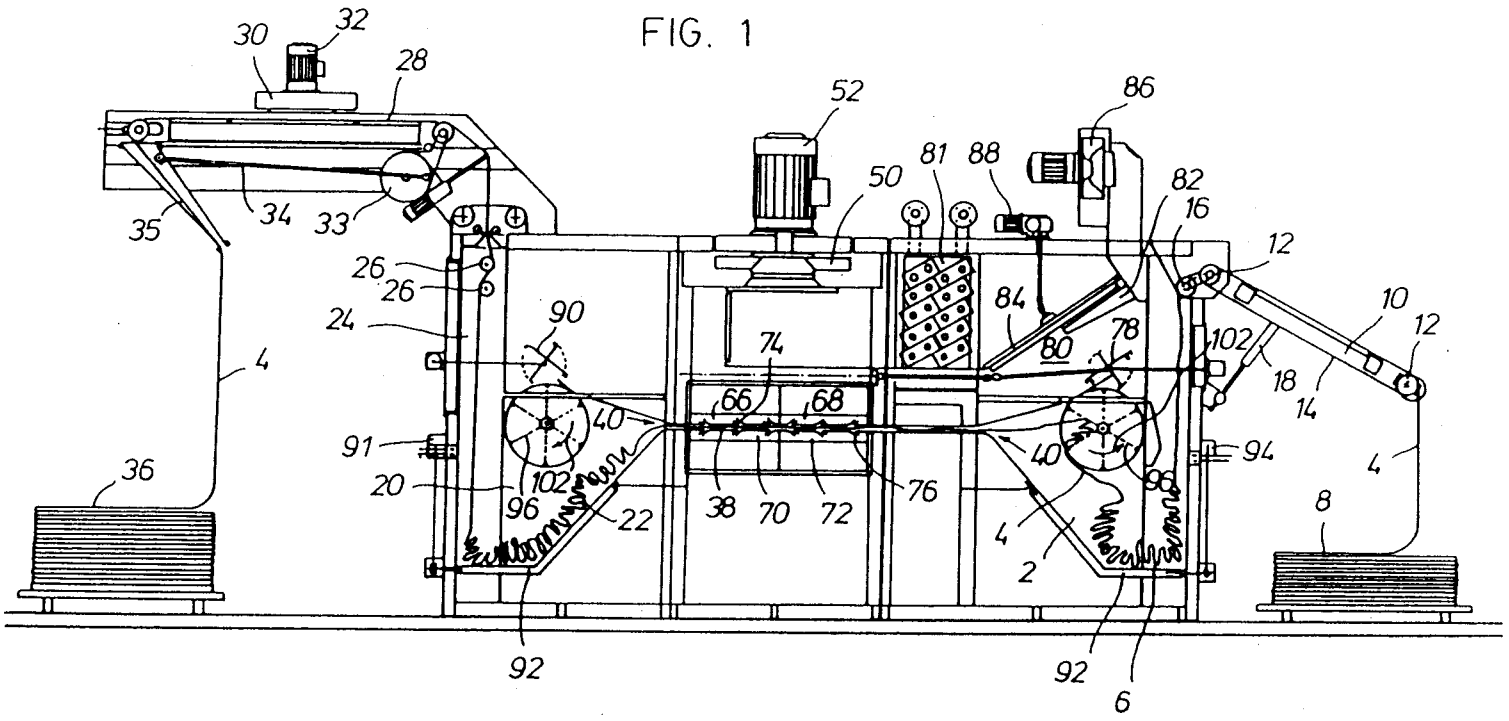
FIG. 1 is a schematic longitudinal section view of the apparatus of the invention.

The apparatus comprises a first chamber 2 for the fabric 4 disposd in open width form. An input reserve 6 of said open width fabric may be formed in said chamber 2. Outside the apparatus, the fabric 4 is disposed, for example, forming a folded pile 8, although it may be disposed otherwise, for example forming a roll. From the pile 8 (or roll or otherwise) the fabric 4 gradually enters said first chamber 2 via the device 10 which comprises roller 12 guiding an endless belt, delivering the fabric 4 to an infeed roller 16. There are mechanical means for actuating the device 10, which may rock under the action of a control arm 18 for the angular position of the device. The endless belt 14 moves slowly, whereby the fabric 4 enters the apparatus slowly, albeit continuously. Opposite to said first chamber 2, there is a second delivery chamber 20, in which a delivery reserve 22 may be formed and from which the fabric 4 may also be slowly removed through a space 24 where it is engaged by selvage openers 26 formed by pairs of rollers which smooth out the fabric edges. The fabric reaches a conveyor belt 28 provided with orifices to allow the passage therethrough of a current of air blown by a fan 30 having a motor 32. This air current cools the fabric. A cam 32 having a connecting rod 34 reciprocates a folding arm 35 to dispose the already treated fabric 4 suitably in a pile 36 of folded fabric. Obviously other possibilities are contemplated, such as, for example, to take the fabric up on a beam. In a similar fashion to the infeed end, the fabric delivery is substantially continuous, although slow.

The two chambers 2, 20 are in communication over a passage 38 of flattened section, adapted to contain the fabric in open width form. The passage 38 is provided with a port 40 in each of the chambers 2, 20 and the fabric passes through said ports when being transferred into the corresponding chamber.

Figure 4:
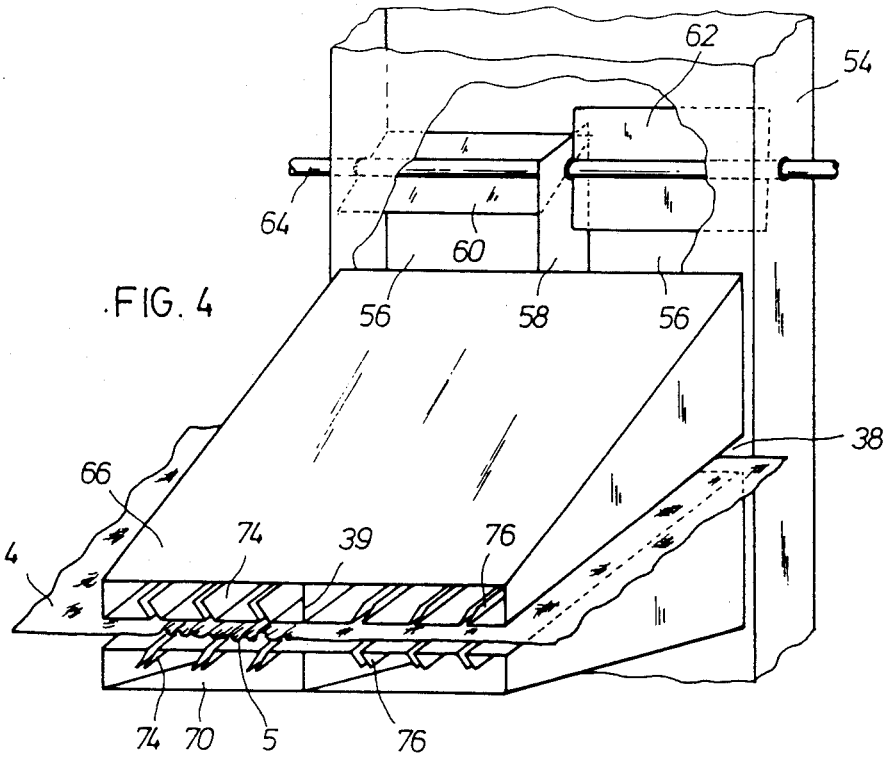
FIG. 4 is a schematic perspective view of part of the lower and upper blast orifices associated with a vertical chamber, the blower means and the communication of the latter with the vertical chamber having been omitted; the Figure also shows the control means situated in the vertical chamber, as well as part of the flattened section passage, in which the fabric to be treated is shown in part.

The passage 38 regularly has width of about 1.8 to 2 meters, without these dimensions being limiting. When the fabric piece to be treated is wide, the whole width of the passage is used. Nevertheless, it is contemplated to divide the passage lengthwise by a wall 39 (FIG. 4), thereby allowing the simultaneous treatment of two fabric pieces of less width. This is of particular interest for goods knitted on circular machines which provide tubular fabrics which are about 0.8 meters wide when laid out flat.

Figure 3:
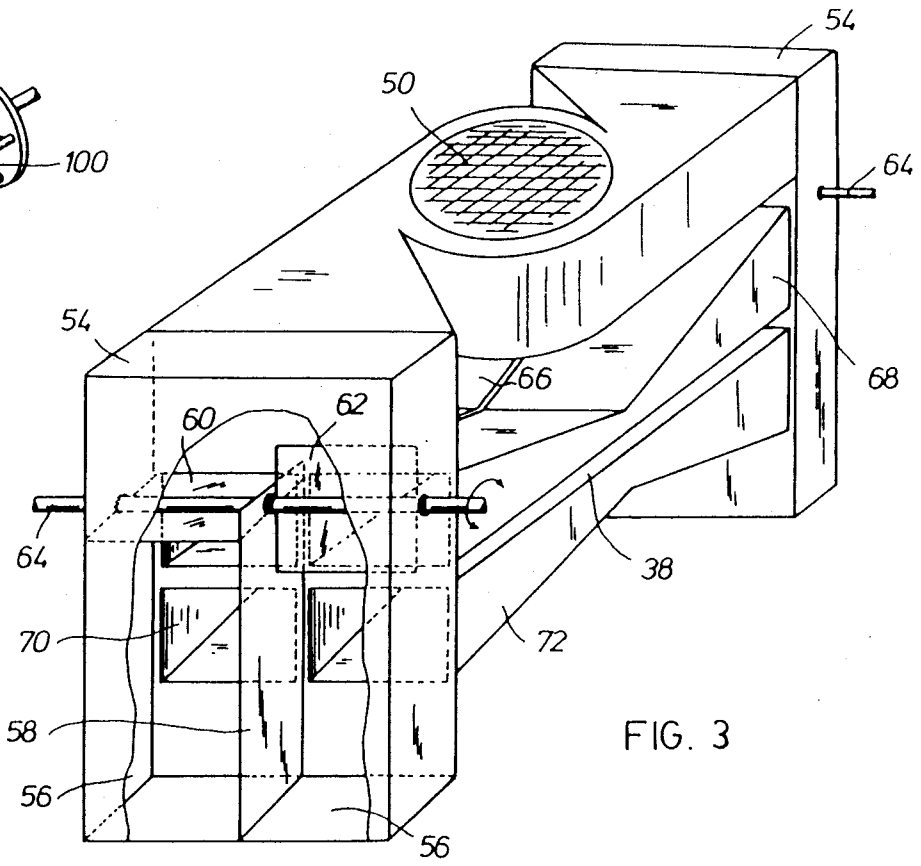
FIG. 3 is a schematic perspective view of the air blast orifices and of the elements placing them in communication with the blower means.
Figure 2:
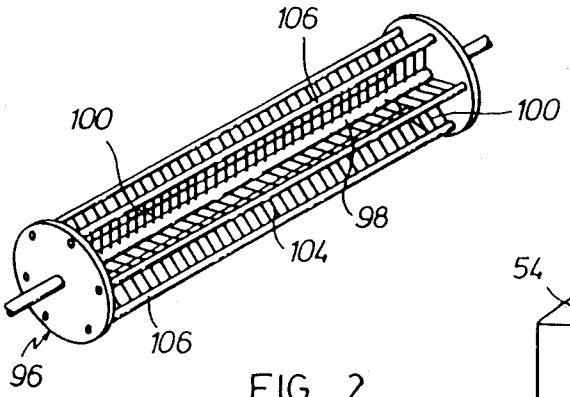
FIG. 2 is a schematic perspective view of a preferred embodiment of the fabric receiving device.

The apparatus also comprises blower means 50, comprising a motor 52, which blow air into said passage 38. The air blown by the means 50 (FIG. 3) flows to vertical chambers 54, each of which is located adjacent one side of the machine. Each vertical chamber 54 is generally divided into two semi-chambers 56 by a vertical wall 58.

Between the two vertical chambers 54 there extend two adjacent upper blast orifices 66, 68 and two adjacent lower blast orifices 70, 72. Said blast orifices define at least one longitudinal portion of the passage 38 and they are transversely disposed relative to said passage, i.e. while the passage 38 extends in the longitudinal direction of the machine between the ports 40, the blast orifices extend transversely thereto. Preferably said blast orifices are provided with a decreasing air flow section from the ends towards the central portion thereof, as may be seen in FIG. 3.

The blast orifices 66 and 70 are in communication with the passage 38 through a first set of slots 74 which slope relative to said passage, causing the air entering in the passage to flow towards the first chamber 2. In turn, the blast orifices 68 and 72 are provided with a second set of slots 76, sloping the other way and directing the air entering in the passage 38 towards the second chamber 20. The slopes do not provoke turbulence in the air flow. Said slots are not shown in FIG. 3.

For the air blown by the blower means 50 to follow appropriate routes, there is a first set of gate valve means comprising control means 60 for directing the air to the first set of slots 74 (one of said means existing in each vertical chamber 54) and control means 78 for the return air flow from the first chamber 2 to the blower means 50.

A second set of gate valves comprising similar control means 62 for directing the air to the second set of slots 76 (there is also one in each vertical chamber 54) and return air flow control means 90 for the air flowing from the second chamber 20 to the blower means 50.

Said access control means 60, 62 and said return control means 78, 90 are movable between respective open and closed positions. Preferably the control means 60, 62 are butterfly valves and rotate about a common shaft 64, being preferably offset by 90° one from the other. When the shaft 64 is actuated with one control means 60 closing the path to one semi-chamber 56 (and, therefore, to one set of slots 74), the other control means 62 allows the access to the other semi-chamber 56 and, therefore, to the other set of slots 76, free.

When the blast orifices 66 and 70 are open, i.e. when the air flows towards the first chamber 2, the control means 78 situated at the upper end of the chamber 2, is opened and allows the air flow into the space 80 and, prior to being heated by the radiator means 81 and reinitiating the cycle, flows through a suction port 82 and a rotary filter 84 where any fly formed is collected and is removed by the exhaust fan 86. The filter is driven in turn by the motor 88.

When the air flows in the opposite direction, i.e. towards the chamber 20, the control means 78 is closed and the other control means 90 is opened, the air being transferred also through the space 80 through a not shown duct. The operation of these return control means is synchronised with that of the control means 60, 62.

Each of the chambers 2, 20 is provided with a platform 92 adpated to support the corresponding reserve 6, 22 and said platforms 92 are adapted to rock slightly under the weight of the fabric. This rocking movement is picked up by a detector 91 or other device adapted to emit an electrical signal activating the actuating means for all the gate valves. There are means for predetermining the weight of the fabric required to cause such actuation.

There is a fabric receiving device 96 in the interior of each of the chambers 2, 20. Such device 96 is substantially facing the corresponding port 40. When the fabric 4 enters a chamber (chamber 2 in FIG. 1), it is forced strongly by the air and, therefore, the device 96 receives the said fabric and, without retaining it, allows it to fall thereafter on the platform 92. The device 96 allows the air flow therethrough and comprises preferably a horizontal rotary shaft 98. A plurality of angularly spaced apart rotary blades 100 fixedly attached to the shaft extend therefrom. The blades rotate in the direction of the arrows 102, i.e. they favour the immediate delivery of the fabric received to the platform 92.

Each blade 100 is preferably formed by a plurality of radial rods 104 extending between the shaft 98 and a crossmember 106 preferably parallel to the shaft 98.

The operation of the device 96 allows the fabric to be piled in an orderly fashion avoiding the appearance of entanglements which may substantially hinder the further passage of the fabric 4 through the passage 38.

The device 96 rotates at a low speed, of about 16 r.p.m. and is provided with drive means having an automatic stop mechanism if the device is subjected to an abnormally high stress.

The invention also comprises other configurations of the device, provided that the conditions of allowing the air to pass therethrough and of receiving the fabric without retaining it are met.

The apparatus operates as follows: the fabric 4 is first fed by hand completely flat over the rollers 12, the corresponding drive means being set running for about one minute, whereby a sufficient amount of fabric is deposited on the platform 92 of the chamber 2. Through suitably disposed side doors not shown in the drawings, the leading edge of the fabric is fed by hand up to the level of the slots 76 and when the blower means 50 are set running, the air flow transports the fabric to the chamber 20, from where the fabric is fed by hand through the selvage spreaders 26 and endless belt 28.

Thereafter a substantial length of fabric is fed into the machine until the input reserve 6 is formed and the fabric is then moved with the aid of the blower means 50 until the delivery reserve 22 is formed. The fabric 4 is moved by the airflow through the semi-chamber 56, blast orifices 68 and 72, slots 76 and passage 38 into the delivery chamber 20. The airflow continues through the open gate valve 90, filters 84 and heating means 81 from where it reaches the blower means 50 again, the cycle being restarted.

As stated above, the fabric 4 is forced into the corresponding chamber 2, 20 through the port 40, whereby it collides against the device 96. The slow rotation of the latter causes a gentle delivery of the fabric on the platform 92, practically without any risk of the fabric becoming entangled.

Almost all of the reserve 22 rests on the rocking platform 92. When this reserve reaches the predetermined weight referred to above (which coincides with a substantial exhaustion of the input reserve 6), the platform 92 rocks and thereby reverses the air flow until the weight of the input reserve 6 in the infeed chamber 2 is sufficient to reverse the air flow again, the movement from one chamber to the other being repeated as often as required.

In the meantime, new untreated fabric is being gradually fed in and the operation of the delivery mechanism removes the already treated fabric from the apparatus, said fabric thereby being treated continuously.

At the delivery end air is blown through the conveyor belt 28, whereby the fabric 4 is cooled down from the temperature inside the apparatus to room temperature.

The treatment parameters are determined by the adjustable speeds of the infeed and delivery motors; by the fabric speed which is adjustable in dependence of the air blown by the blower means; on the adjustable temperature provided by the heating means. Therefore, a highly uniform level of surface finish is attained within a broad range of possibilities, together with a high drying performance and notable productivity and reduction of the process costs are attained.

As it moves through the passage 38, the fabric is not subjected to mechanical tension or harmful friction with the surfaces of the apparatus, since such movements take place practically without contact with the passage walls, due to the air flow in one direction or the other.

The following types of treatment may be achieved: cotton fabrics may be aged, crimped, softened and shrunk; woollen fabrics may be felted, softened and dimensionally stabilised; all types of finishes corresponding to each class of fiber are obtained with fiber blend fabrics.

It should be noted that the fabric is not subject to any traction force either at the infeed or on delivery. Furthermore, the reversal of the air flow is achieved by a reserve of fabric, which implies no tractive force either, contrarily to what happens in other embodiments in which the air flow reversal is effected by the movement of a lever when the fabric is exhausted in one of the chambers, said fabric engaging the lever and therefore being undesirably pulled.

The fabric 4 is usually treated as described, i.e. such that the air flows exclusively in one of the said directions, either towards the first chamber 2 or towards the second chamber 20.

Figure 5:
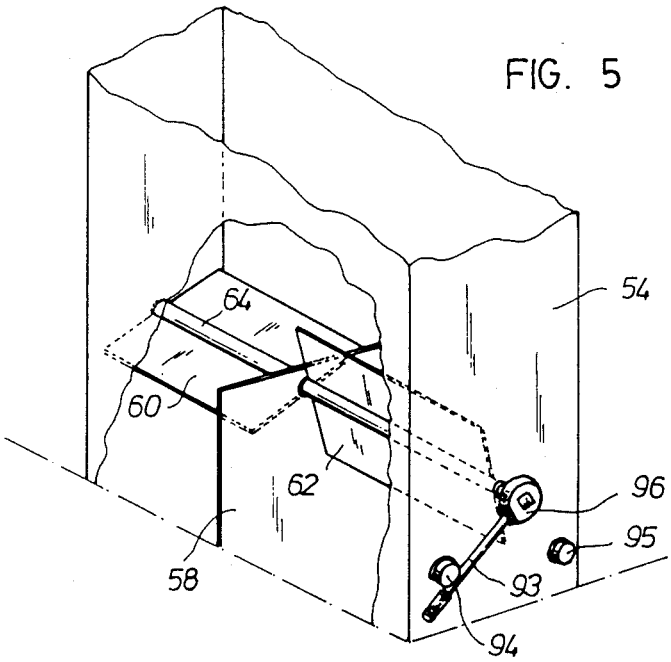
FIG. 5 is a schematic perspective view of a vertical chamber, showing in part the control means situated therein, there also being shown the radial rod and the adjustable stop means; for clarity, the blower means and blast orifices have been omitted.

Nevertheless, in certain cases (FIGS. 4 and 5) a position close to or coincident with the open position of the control means for one of the slot sets 74, 76 (e.g. the control means) are made to correspond with an intermediate position between the open position and the closed position of the other control means (e.g. the control means 60). This intermediate position usually allows a flow rate of from 10 to 20% by volume of the air flowing from the blower means 50 to flow through.

Nevertheless, the control means 78, 90 are held such that when one is open the other is closed and vice versa.

Thus unequal opposed airflows occur in the passage 38. Such currents are: a main flow from the slots 76 (or 74) associated with the semi-chamber 56 which maintains the corresponding control means 62 (or 60) substantially open and also the return flow control means 90 (or 78) open; and a secondary flow from the slots 74 (or 76) associated with the semi-chamber 56 which maintains the control means 60 (62) only partially open and the air return flow control means 78 (or 90) closed.

The main flow is dominant and transfers the fabric 4 to the corresponding chamber 2 or 20. Nevertheless, the secondary flow provides a slight braking force, whereby the fabric 4 is compacted, possibly forming wrinkles 5 which are not maintained in the fabric.

As stated above, the control means 60, 62 are preferably butterfly valves and are offset in 90° . It is contemplated that the common shaft 64 be provided with a radial lever arm 93, held in place by a clamp 97 and which may be moved between adjustable stops 94, 95. When the radial lever arm 93 contacts one of the stops 94, one control means (e.g. means 62) is almost fully open and the other control means (e.g. means 60) is only slightly open; when the common shaft 64 is rotated, said lever arm contacts the other stop 95 and the positions of the control means 60 and 62 are reversed. The stops 94 and 95 may be moved, such that the contact thereof with the lever arm 93 represents different angles of slope of the control means 60, 62. Obviously, similar devices are to be found in both vertical chambers 54.

The arm 93 may be withdrawn from the clamp 97, in which case the rotation of the common shaft 64 and of the butterfly valves 60, 62 becomes independent of the position of the stops 94, 95.

On certain occasions, particularly when the fabric to be treated is heavy (e.g. because it has absorbed much water), it is difficult to transport the fabric from one reserve 6, 22 up to entry in the passage 38. On the other hand, at the exit from the said passage 38, the weight of the fabric may cause it to fall on the platform 92 before it reaches the device 96. In this way the reserve 6, 22 is formed in a rather disorderly way and there is the risk of entanglement, as mentioned above.

Figure 6:
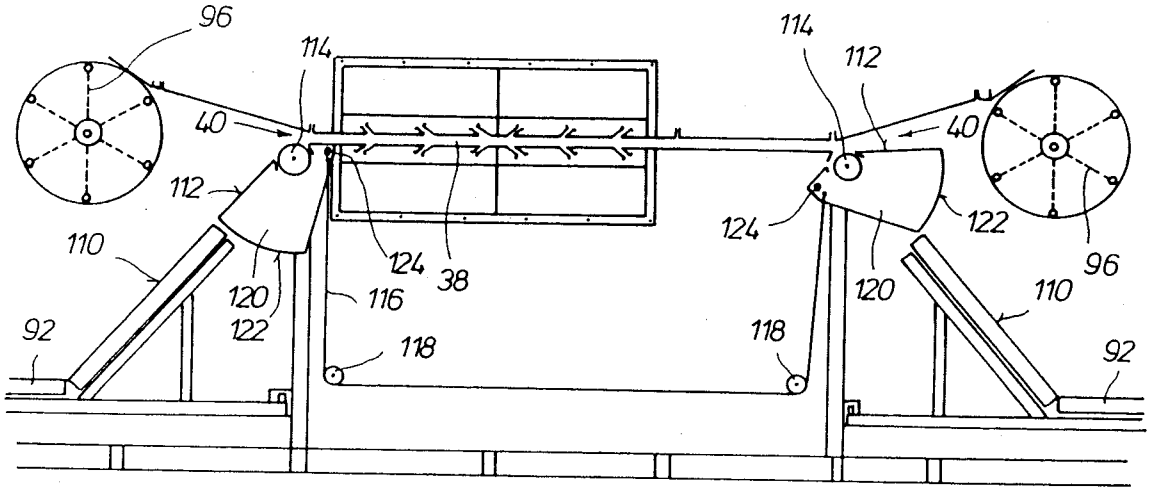
FIG. 6 is a schematic view, partly in longitudinal section of the apparatus of the invention, showing particularly the moving planes adjacent the passage.

To avoid these drawbacks, between each platform 92 and the adjacent port 40 of the passage 38 there is a fixed sloping plane 110, adapted to serve as a support and guide for the fabric entering in the passage. Beyond the fixed sloping plane 110, there is moving plane 112 which may rock between a first position of alignment with the fixed sloping plane 110 (at the left in FIG. 6) and a second position of substantial alignment with the passage 38 (right of FIG. 66.)

The first position of alignment of the moving plane 112 is the appropriate one when the fabric travels from a reserve 6, 22 to the passage 38 and the second position of said moving plane is the appropriate one when the fabric emerges from the passage 38, since this facilitates the fabric reaching the device 96 and consequently facilitates a desirable formation of the corresponding reserve.

Furthermore, between each moving plane 112 and each port 40, there is an idler roller 114, the upper portion of which is generally flush with the bottom of the passage 38. The presence of this roller 114 facilitates the entry of the fabric in the passage. The axis of rotation of each roller 114 coincides with the axis of rocking of the corresponding moving plane 112.

There are provided rocking means for said moving planes 112 and said means operate such that when one of the moving planes 112 is in the first position, the other moving plane in the second position thereof. Between these means there are cables 116 or the like guided over pulleys 118 and the opposite ends of the cables 116 are attached to the moving planes thereby causing the alternation of the said positions. The rocking means are associated with gate valve drive means which alternately control the flow of air to one set of slots 74, 76 or the other and therefore from one chamber 2, 20. In view of this association, the opening of the gate valves leading the air to one chamber 2, 20 causes the moving plane 112 close to the chamber receiving the air flow to be in the second position.

Preferably, the moving planes 112 are extended by side skirts 112 and by a front skirt 120, to avoid the fabric from entangling with the moving planes. Furthermore, the existence of counterweights 124 to reduce the rocking effort.

What I claim is:

1. Apparatus for dry treatment of a fabric, comprising a first chamber and a second chamber each of which is provided with a platform supporting a reserve of open width fabric, said first chamber being for an inlet reserve and said second chamber being for a delivery reserve; means gradually feeding the fabric into said first chamber; means gradually removing the fabric from said second chamber; a passage having a flattened section containing the fabric in open width form and placing said chambers in communication with each other, having in each of the latter a port through which the fabric passes; a first set and a second set of slots connecting into said passage for directing air respectively towards said first chamber or second chamber; blower means blowing air into said slots; heating means for heating said air; first and second sets of gate valves comprising access control means for controlling access of the air respectively to the first set or second set of slots and return control means of the air return respectively from the first chamber or second chamber to the blower means, said access control means and said return control means being movable between an open position and a closed position; and actuating means for said gate valve sets, a fabric receiving device positioned in the inside of each of said chambers generally facing the corresponding port of the passage, said fabric receiving device allowing the air to flow therethrough and adapted to receive the fabric driven into the chamber from the passage without retaining it.

2. The apparatus of claim 1, characterised in that said fabric receiving device comprises a horizontal rotation shaft from which there extend lengthwise a plurality of angularly spaced rotary blades fixedly attached to said shaft and adapted to receive said fabric successively, without retaining it.

3. The apparatus of claim 2, characterised in that each of said rotary blades is formed by a plurality of radial rods extending between the shaft and a crossmember.

4. The apparatus of claim 1, characterised in that each of said platforms is capable of rocking slightly under the weight of the fabric and said rocking movement actuates said gate valve drive means.

5. The apparatus of claim 1, characterised in that said flattened section passage is straight and extends longitudinally between the port of each chamber and at least one longitudinal portion of the passage is defined between two adjacent upper blast orifices and two adjacent lower blast orifices, all transversely disposed relative to the passage, said blast orifices receiving the air from the blower means and being in communication with the passage via said slots.

6. The apparatus of claim 1, characterised in that said upper and lower blast orifices are provided with a decreasing air passage section from the ends thereof to the centre portion thereof.

7. The apparatus of claim 1, characterised in that a position close to or coincident with the open position of the control means associated with one of the slot sets corresponds to an intermediate position between the open and closed positions of the other control means whereby unequal opposed air currents may counterflow in said passage, causing a fabric compacting effect, compatible with a transfer of the fabric towards one of the chambers.

8. The apparatus of claim 7, characterised in that said intermediate position allows an air flow rate of between 10 and 20% by volume of the air flow from the blower means.

9. The apparatus of claim 1, characterised in that the open position of one of said return control means corresponds to the closed position of the other return control means.

10. The apparatus of claim 1, characterised in that both access control means are rotary around a common shaft and are offset 90° from each other.

11. The apparatus of claim 10, characterised in that said common shaft is associated with a radial lever arm, there being adjustable stop means allowing said rod to pivot between two extreme positions, each of which corresponds to a position close to the open position of an access control means and to an intermediate position close to the closed position of the other access control means.

12. The apparatus of claim 1, characterised in that between each platform and the passage there are provided successively a fixed sloping plane and a moving plane, capable of rocking between a first position in alignment with said fixed sloping plane and a second position of substantial alignment with said passage, there being rocking means such that when one of the moving planes is in said first position, the other moving plane is in the said second position.

13. The apparatus of claim 12, characterised in that said rocking means are associated with said gate valve set actuating means, such that the opening of the gate valves determining the passage of the air to one chamber or the other causes the moving plane close to the chamber receiving the air to be in said second position.

14. The apparatus of claim 12, characterised in that between each moving plane and each port of the passage there is an idler roller disposed horizontally.

* * * * *